US009289650B2

(12) United States Patent
Willey

(10) Patent No.: US 9,289,650 B2
(45) Date of Patent: Mar. 22, 2016

(54) MULTI-PURPOSE ICE AXE INCLUDING ROTATING SPIKE

(71) Applicant: 2think, LLC, Fort Collins, CO (US)

(72) Inventor: Kevin E. Willey, Fort Collins, CO (US)

(73) Assignee: 2think, LLC, Fort Collins, CO (US)

( * ) Notice: Subject to any disclaimer, the term of this patent is extended or adjusted under 35 U.S.C. 154(b) by 39 days.

(21) Appl. No.: 14/281,618

(22) Filed: May 19, 2014

(65) Prior Publication Data

US 2015/0328499 A1 Nov. 19, 2015

(51) Int. Cl.

| | |
|---|---|
| ***A63B 29/08*** | (2006.01) |
| ***B25F 1/00*** | (2006.01) |
| ***B26B 23/00*** | (2006.01) |
| ***B25D 7/00*** | (2006.01) |

(52) U.S. Cl.

CPC . *A63B 29/08* (2013.01); *B25D 7/00* (2013.01); *B25F 1/00* (2013.01); *B26B 23/00* (2013.01)

(58) Field of Classification Search

CPC ..... B26B 23/00; B25F 1/10; B25F 1/02; B25F 1/04; B25D 7/00; A63B 29/08

See application file for complete search history.

(56) References Cited

U.S. PATENT DOCUMENTS

| | | | | | |
|---|---|---|---|---|---|
| 4,023,606 | A | | 5/1977 | Kneissl | |
| 4,308,628 | A | * | 1/1982 | Kunberger | A63B 29/08 7/145 |
| 4,476,597 | A | * | 10/1984 | Gobbi | A63B 29/08 30/164.5 |
| 5,400,512 | A | * | 3/1995 | Brush | B26B 5/00 30/321 |
| 5,768,727 | A | * | 6/1998 | Brainerd | A63B 29/08 7/145 |
| 6,378,153 | B1 | * | 4/2002 | Morgan | A01B 1/022 294/51 |
| 7,225,544 | B2 | * | 6/2007 | Petzl | A63B 29/08 30/308.2 |
| 7,533,469 | B2 | * | 5/2009 | Skrivan | A63B 29/08 30/308.1 |
| 7,735,172 | B2 | * | 6/2010 | Newton | A62C 8/00 7/145 |
| 2015/0328499 | A1 | * | 11/2015 | Willey | A63B 29/08 30/359 |

FOREIGN PATENT DOCUMENTS

| | | | |
|---|---|---|---|
| DE | 3442933 | | 6/1986 |
| EP | 2 471 581 | | 7/2012 |
| FR | 2 360 387 | * | 3/1978 |
| JP | 8-47874 | * | 2/1996 |
| SU | 1657210 | | 6/1991 |

OTHER PUBLICATIONS

Corresponding Patent Coopertion T International Patent Application No. PCT/US2015/030651, International Search Report and Written Opinion mailed Jul. 13, 2015, 9 pages total.

* cited by examiner

*Primary Examiner* — Hwei C Payer

(74) *Attorney, Agent, or Firm* — Craig R. Miles; CR Miles, P.C.

(57) ABSTRACT

Generally, a spike including a rotary position selector which allows selectable incremental fixed angular positioning of the spike, the spike adaptable to couple to a tool. Specifically, an ice axe having a rotatable spike which allows selectable fixed angular positioning of the spike in relation to the shaft of the ice axe.

17 Claims, 11 Drawing Sheets

MULTI-PURPOSE ICE AXE INCLUDING ROTATING SPIKE

I. FIELD OF THE INVENTION

Generally, a spike including a rotary position selector which allows selectable incremental fixed angular positioning of the spike, the spike adaptable to couple to a tool. Specifically, an ice axe having a rotatable spike which allows selectable fixed angular positioning of the spike in relation to the shaft of the ice axe.

II. BACKGROUND OF THE INVENTION

Conventional ice axes typically include a head and a spike fixedly coupled to opposite ends of a shaft. The spike tip typically aligns with the central longitudinal axis of the shaft to provide a spike which linearly extends from the shaft end. Additionally, conventional ice axes may not allow selectable fixed angular positioning of the spike in relation to the shaft of the ice axe. Moreover, the head of conventional ice axes may include a pick having a planate blade lacking any orthogonal element coupled to the blade top edge and a planate adze lacking any orthogonal element.

There can be disadvantages in the conventional configuration of ice axes in that the spike cannot be driven into the snow or ice slope to arrest the user's slide upon the snow or ice slope. Similarly, a blade without an orthogonal element may readily advance through a snow or ice slope to effectively arrest the user's slide upon the snow or ice slope.

There would be an advantage in an ice axe which included a spike rotatable, or which allowed selectable fixed angular positioning, in relation to the shaft of the ice axe or included a blade or adze with orthogonal elements.

III. SUMMARY OF THE INVENTION

A broad object of embodiments of the invention can be to provide a spike including a rotary position selector which allows selectable incremental fixed angular positioning of the spike about a spike rotation axis.

Another broad object of embodiments of the invention can be to provide an ice axe including a shaft having a length disposed between a shaft first end and a shaft second end, a head coupled to the shaft first end and a spike rotatably coupled to the shaft second end. As to particular embodiments, the ice axe can further include a rotary position selector which allows selectable incremental fixed angular positioning of the spike about a spike rotation axis.

Another broad object of embodiments of the invention can be to provide an ice axe including a shaft having a length disposed between a shaft first end and a shaft second end, a head coupled to the shaft first end, the head having a pick including a planate blade having a pair of planar blade faces bound by a blade top edge and a blade bottom edge, the pair of blade faces extending outwardly from the head body to terminate in a blade tip and a planate fin coupled to the blade top edge along a fin medial portion with a fin first side and a fin second side disposed on opposite sides of the blade top edge.

Another broad object of embodiments of the invention can be to provide an ice axe including a shaft having a length disposed between a shaft first end and a shaft second end, a head coupled to the shaft first end including a planate adze member having a top side and a bottom side which taper to an adze terminal element and an elongate rib extending medially along the length of the bottom side which angles inwardly proximate the adze terminal element to provide a rib cutting edge.

Another broad object of embodiments of the invention can be to provide an ice axe having a head assembly including matable halves configured to hold a discrete pick and a discrete adze, the mated halves adapted to couple to a shaft first end of an ice axe.

Naturally, further objects of the invention are disclosed throughout other areas of the specification, drawings, and claims.

IV. BRIEF DESCRIPTION OF THE DRAWINGS

V. DETAILED DESCRIPTION OF THE INVENTION

Figure 1A:
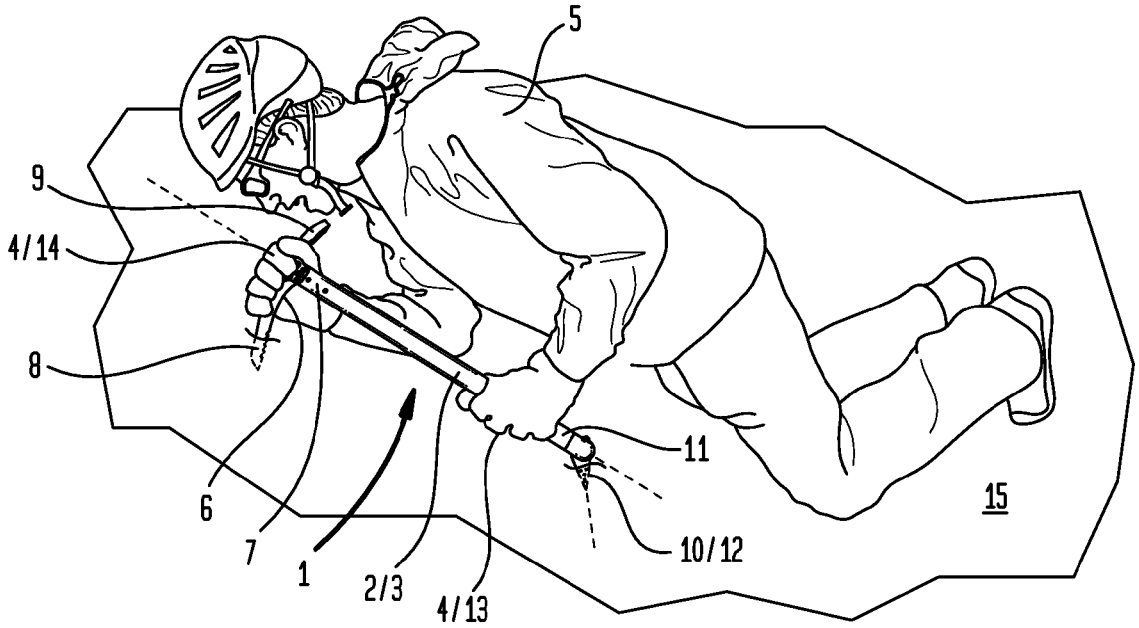
FIG. 1A is an illustration of a particular method of using a particular embodiment of the inventive ice axe.

Now referring to FIG. 1A, embodiments of the inventive ice axe (1) include one or more of: a shaft (2) having a shaft external surface (3) configured for gripping engagement by one of pair of hands (4) of a user (5), a head (6) coupled to a shaft first end (7) including an inventive pick (8) or an inventive adze (9) which outwardly extend from the shaft first end (7), and a spike (10) rotatably coupled to a shaft second end (11) which allows selectable fixed angular positioning of the spike (10) in relation to the shaft (2).

FIG. 1A further shows an illustrative method for use of the inventive ice axe (1) having the spike (10) established in a fixed angular position (12) to the shaft (2). The user (5) can grip the shaft (2) in a first hand (13) and grip the head (6) in a second hand (14). The pick (8) can be driven into a snow or ice slope (15)(or other slope) and the spike (10) can be driven into the snow or ice slope (15) to arrest the user's (5) slide upon the snow or ice slope (15).

Figure 1B:
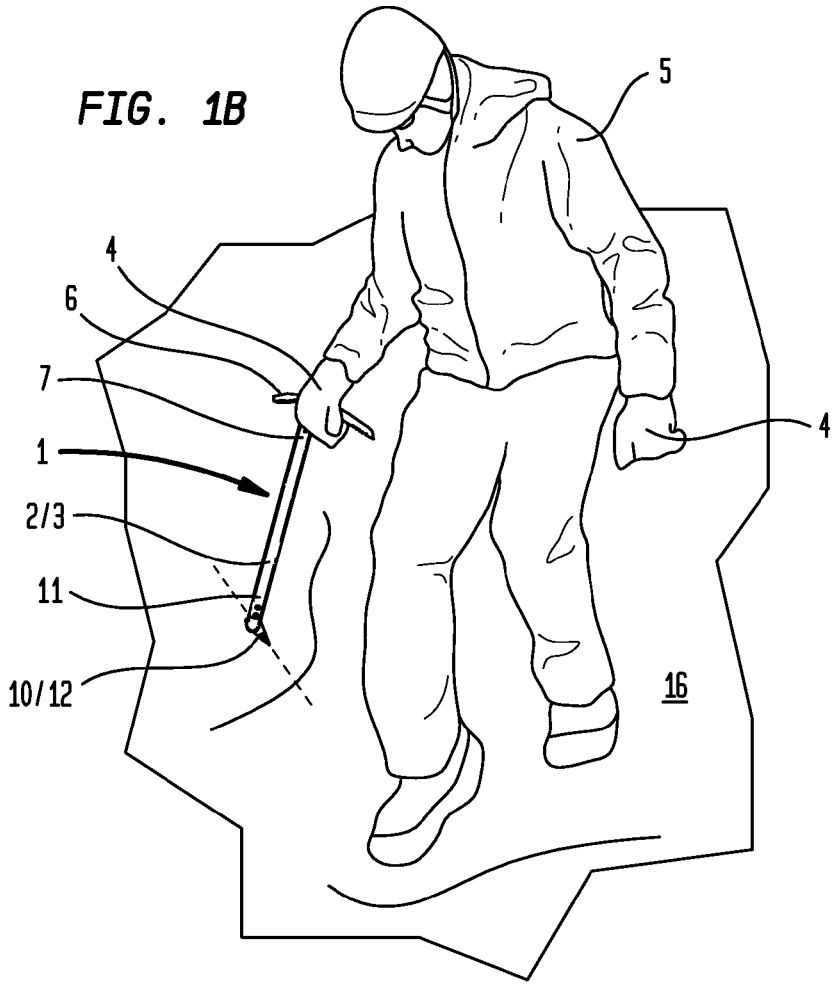
FIG. 1B is an illustration of a particular method of using a particular embodiment of the inventive ice axe.

Now referring to FIG. 1B, which shows an illustrative method for use of the inventive ice axe (1), the spike (10) can be established in a fixed angular position (12) to the shaft (2). The user (5) can grip the head (6) in one of a pair of hands (4) and drive the spike (10) into a walking surface (16)(or other surface) to assist in supporting the user (5). The fixed angular position (12) of the spike (10) in relation to the shaft (2) can assist in removable securement of the spike (10) in the walking surface (16).

For purposes of this invention the term "ice axe" broadly encompasses any object which includes one or more of the inventive features described herein and without limitation to the forgoing encompasses a multipurpose hiking and climbing tool including, or retrofitted to include, one or more of the inventive features described herein.

Now referring primarily to FIGS. 2 through 8, the head (6) can include a pick (8) having a pick planate blade (17) with a pair of planar blade faces (18) disposed in opposed relation a blade width (19) apart. The planar blade faces (18) can be bound by a blade top edge (20) and a blade bottom edge (21) which extend outwardly in relation to the shaft (2) to terminate in a blade tip (22). As to particular embodiments, a planate fin (23) having a fin length (24) disposed between a fin first end (25) and a fin second end (26) and having a fin medial portion (27) disposed between a fin first side (28) and a fin second side (29) can be coupled to the blade top edge (20) along the fin medial portion (27) with the fin first end (25) disposed proximate the longitudinal axis (30) of the shaft (2) to dispose the fin first side (28) and the fin second side (29) on opposite sides of said blade top edge (10). As to particular embodiments, the blade top edge (10) can further include a reverse curve portion (31A). As to particular embodiments, the blade bottom edge (21) can further include a serrated edge portion (31B).

Again referring primarily to FIGS. 3 through 8, the head (6) can comprise an adze (9) including a planate adze member (32) having a top side (33) and a bottom side (34) which extend outwardly in relation to the shaft (2) to terminate in an adze terminal element (35) which can be used to cut or chop. As to certain embodiments, an elongate rib (36) can extend medially along the length of the bottom side (34) of the adze (9). As shown primarily by FIG. 4, proximate the adze terminal element (35), the elongate rib (36) can taper inwardly toward the bottom side (34) of the adze (9) to establish a rib terminal element (37) proximate the adze terminal element (35) the face of which can be used to assist the adze terminal element (35) in cutting or chopping.

Figure 8:
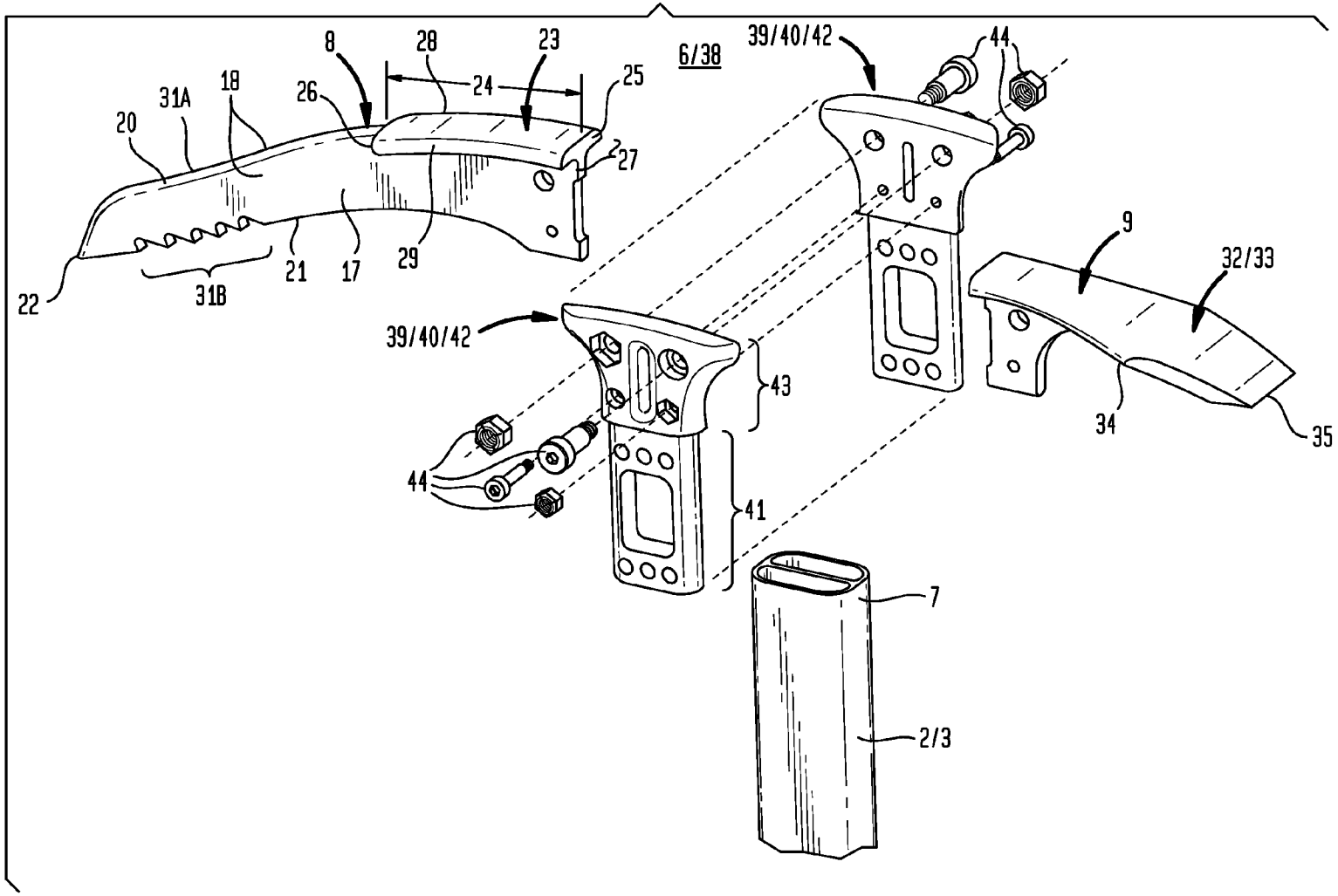
FIG. 8 is an exploded view of the head end of a particular embodiment of the inventive ice axe.

Now referring primarily to FIG. 8, as to particular embodiments, the head (6) can comprise a head assembly (38) including a head body (39) having a pair of body halves (40) which can be mated in fixed relation to provide a body lower portion (41) having a body external surface (42) configured to couple with the shaft first end (7) and a body upper portion (43) configured to retain in fixed relation to the shaft (2) one or more of the pick (8) or the adze (9). The pair of body halves (40) can be fixedly secured to maintain the pick (8) or the adze (9) by mechanical fasteners (44).

Figure 2:
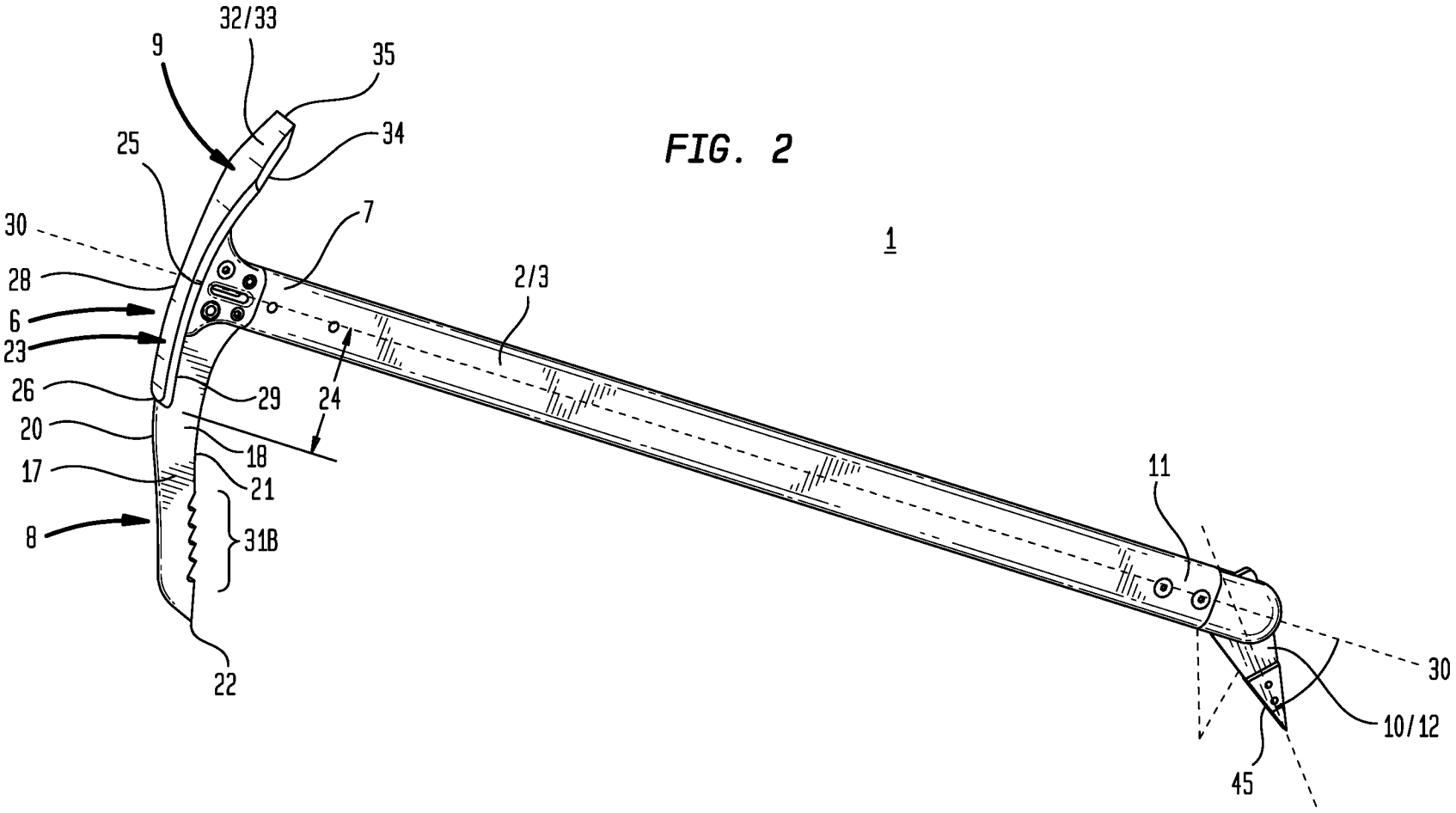
FIG. 2 is a perspective view of a particular embodiment of the inventive ice axe.
Figure 3:
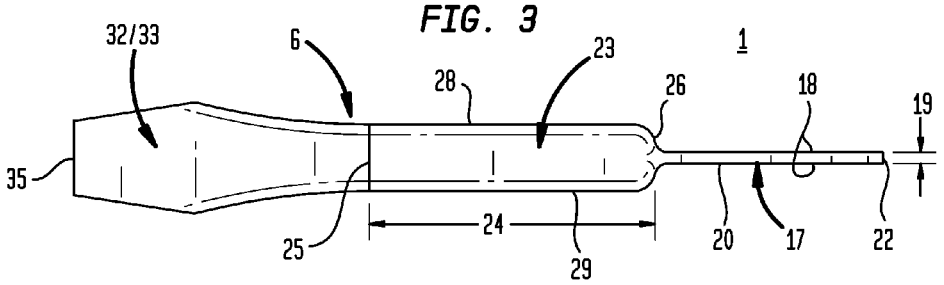
FIG. 3 is a head end view of a particular embodiment of the inventive ice axe.
Figure 4:
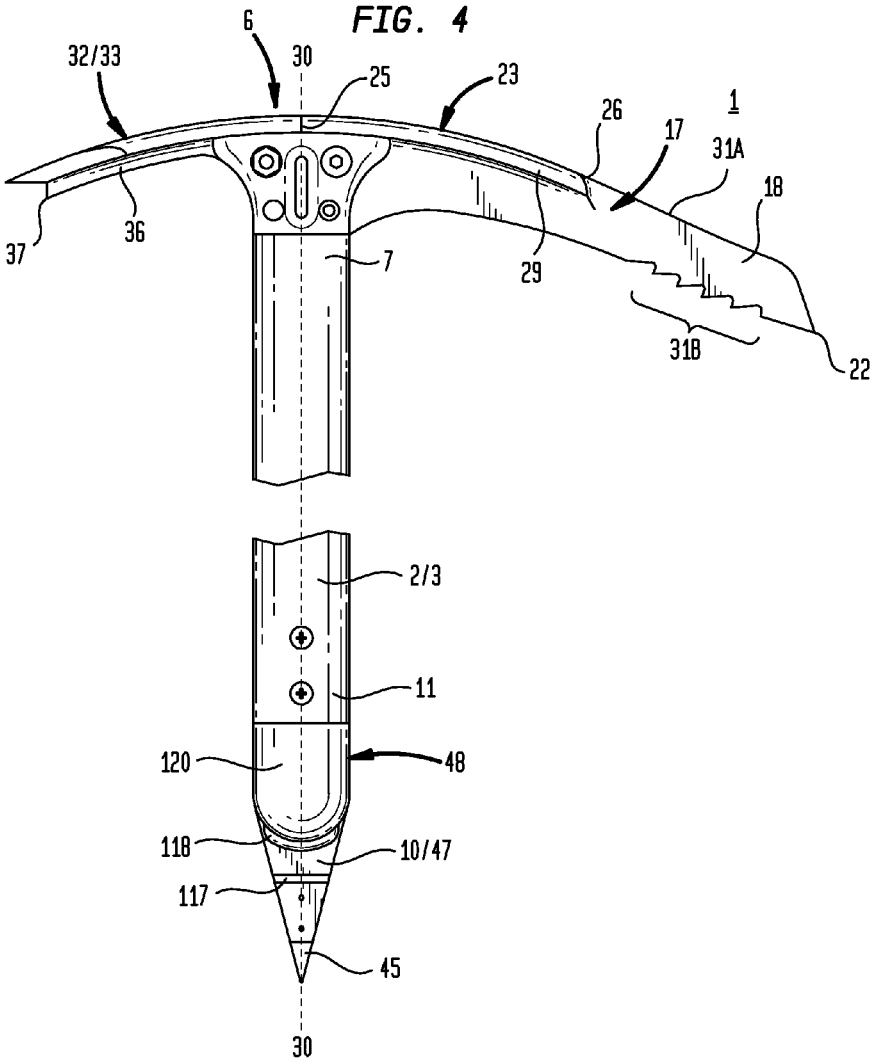
FIG. 4 is a side elevation view of a particular embodiment of the inventive ice axe.
Figure 5:
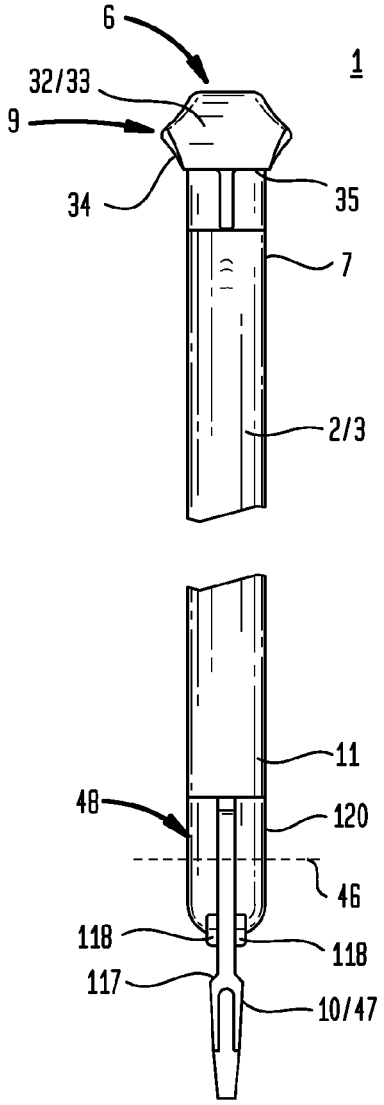
FIG. 5 is a front elevation view of a particular embodiment of the inventive ice axe.
Figure 6:
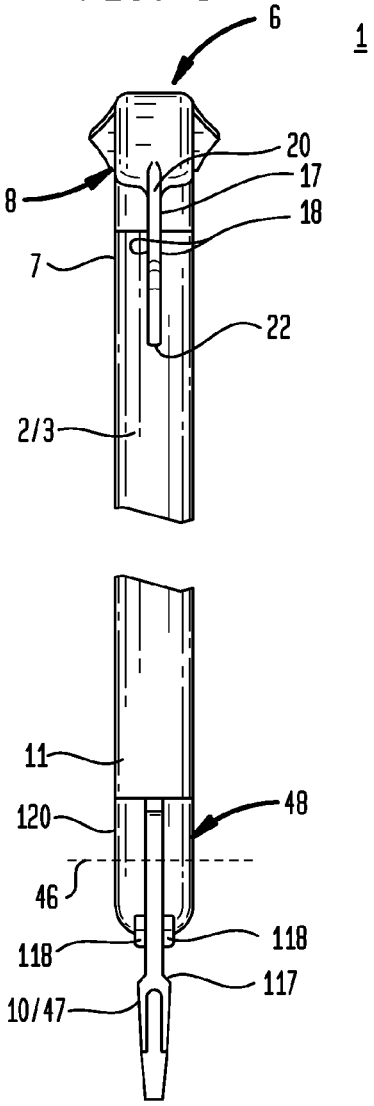
FIG. 6 is a back elevation view of a particular embodiment of the inventive ice axe.
Figure 7:
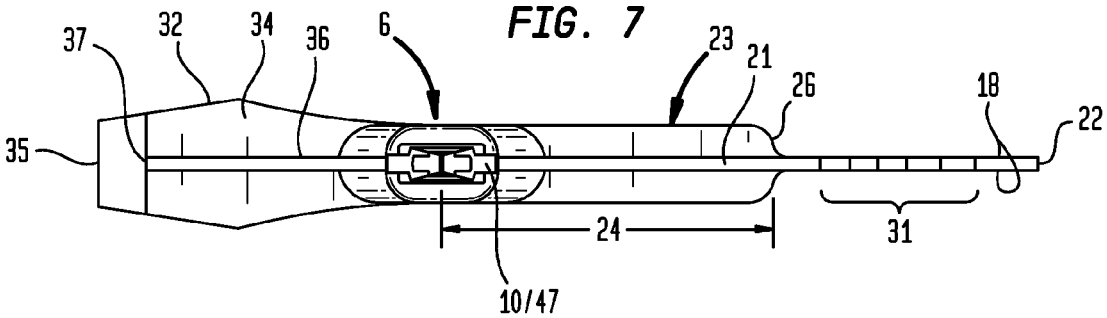
FIG. 7 is a spike end view of a particular embodiment of the inventive ice axe.

Now referring to FIGS. 2 through 7, a particular embodiment of the inventive ice axe (1) includes a shaft (2) having a length disposed between a shaft first end (7) and a shaft second end (11) which terminates in a spike (10) rotatably coupled to the shaft second end (11). As to particular embodiments, the spike (10) can inwardly taper to terminate in a spike tip (45) which can, to a lesser or greater degree, be pointed (as shown in the example of FIG. 4). The spike (10) rotatably coupled the shaft second end (11) can be rotated about a spike rotation axis (46)(as shown in the examples of FIGS. 5 and 6) to establish the spike (10) in a fixed angular position (12) in relation to the shaft (2) of the ice axe (1). As to particular embodiments, the spike (10) can be rotated from a linear position (47) in which the spike tip (45) aligns or substantially aligns with the longitudinal axis (30) of the shaft (2) (as shown in the example of FIG. 4) to a fixed angular position (12) in which the spike tip (45) has an angulated relation to the longitudinal axis (30) of the shaft (2) (as shown in the example of FIG. 2).

As to particular embodiments, the spike tip (45) can travel between the linear position (47) to a fixed angular position (12) of up to about 90° (or substantially perpendicular to the longitudinal axis (30) of the shaft (2) as shown in broken line in the example of FIG. 2). The fixed angular position (12) of the spike (10) can as illustrative examples be maintained by engagement of the spike (10) with a corresponding portion of the shaft (2) or by compressional forces of the shaft (2) upon a corresponding portion of the spike (10). For example, a shaft compression element can be disposed to compress the shaft (2) along the spike rotation axis (46) to dispose the opposed shaft sides of the shaft (2) into forced engagement against the spike (10).

Figure 9:
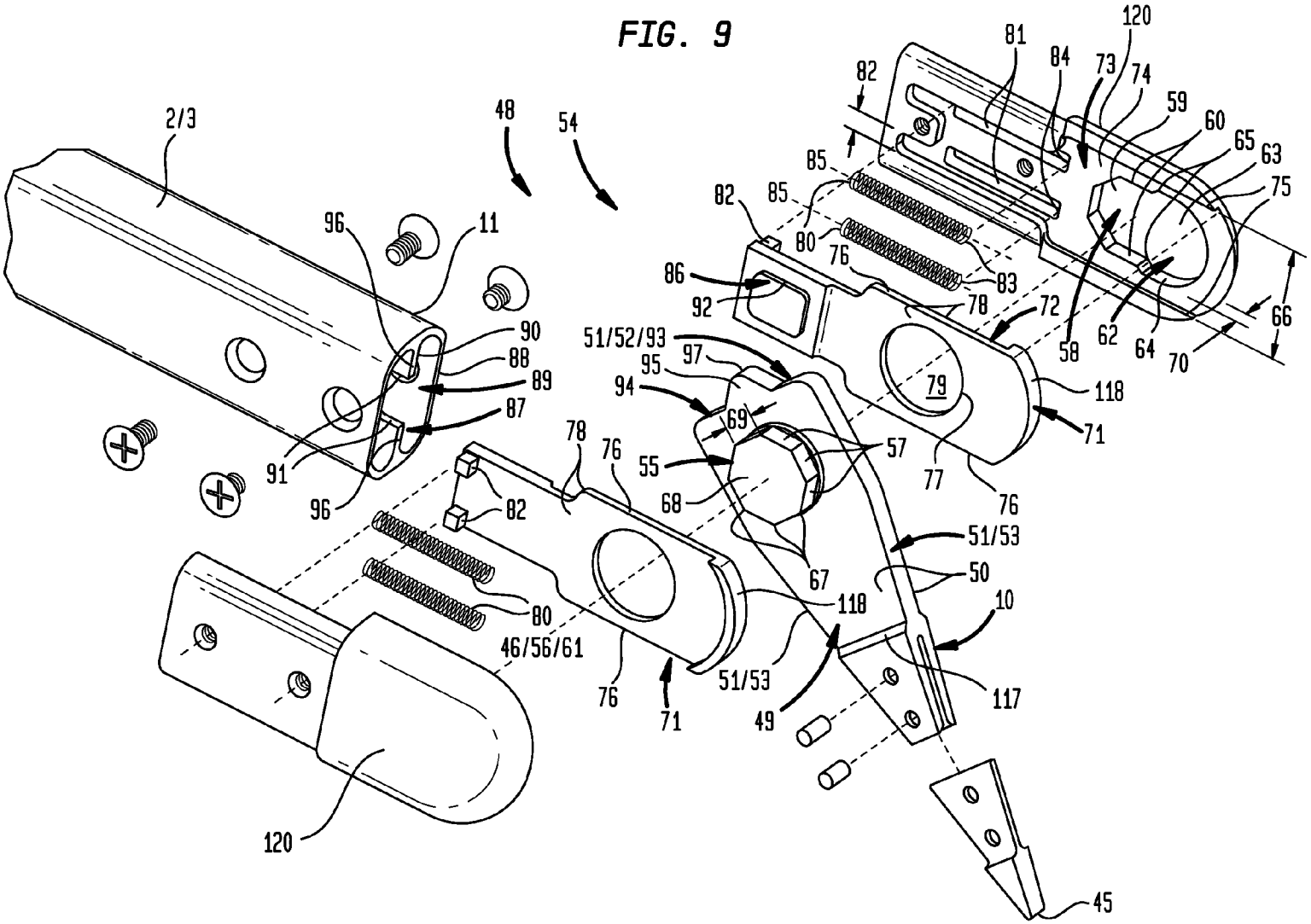
FIG. 9 is an exploded view of the spike end of a particular embodiment of the inventive ice axe.

Now referring primarily to FIG. 9, as to particular embodiments, the spike (10) can be coupled to a rotary position selector (48) which allows selectable fixed angular positioning of the spike (10). The rotary position selector (48) can be operated to incrementally select the fixed angular position (12) in degree increments in either direction from the linear position (47) about the spike rotation axis (46).

As an illustrative examples, as to a particular embodiment, the rotary position selector (48) can be configured to allow incremental selection of 0 degrees (which can be the linear position (47) of the spike (10)) or a fixed angular position (12) of 90 degrees in either direction of rotation from 0 degrees.

As to other particular embodiments, the rotary position selector (48) can be configured to allow incremental selection of 0 degrees (the linear position (47) of the spike (10)) or selection of a fixed angular position (12) in either direction of rotation from 0 degrees to about 30 degrees, about 60 degrees, and about 90 degrees.

As to other particular embodiments, the rotary position selector (48) can be configured to allow incremental selection of 0 degrees (the linear position (47) of the spike (10)) or selection of a fixed angular position (12) in either direction of rotation from 0degrees to about 22 degrees, about 45 degrees, about 67 degrees, and about 90 degrees.

As further described below, these illustrative examples are not intended to be limiting with respect to other embodiments having lesser or greater angular displacement in each selectable degree increment.

Now referring primarily to FIGS. 9 and 10A through 10C, a particular embodiment of the spike (10) can be configured to include a planate body (49) having a pair of spike faces (50)

each having a generally planar surface and disposed in generally parallel opposed relation. The spike faces (50) can define a spike edge (51) including a base edge (52) and a pair of side edges (53) which taper inwardly approaching the spike tip (45). The rotary position selector (48) can include an angular positioning lock (54) including at least one polygonal hub (55) coupled to at least one of the pair of spike faces (50) of the spike (10) with a polygonal hub axis (56) coincident with the spike rotation axis (46) (hereinafter referred to as the "coincident rotation axis" (61)). The polygonal hub (55) can have a hub face (68) joining, in generally perpendicular relation, a plurality of pairs of flat sides (57) disposed in generally opposed parallel relation circumferentially about the polygonal hub (55).

Typically, the plurality of pairs of flat sides (57) can be between two and six, or a greater number of pairs of flat sides, depending upon the angular displacement in each selectable degree increment. As to particular embodiments, the plurality of pairs of flat sides (57) can be selected from the group including or consisting of: two, three, four, five, and six. Each of the plurality of pairs of flat sides (57) can afford a fixed angular position (12) of the spike (10) about the coincident rotation axis (61). While the illustrative example of the polygonal hub (55) shown in the Figures includes a plurality of pairs of flat sides (57) in an octagonal configuration, this is not intended to limit the plurality of pairs of flat sides (57) to four, and particular embodiments can have a lesser number of pairs of flat sides (57) even one pair of flat sides (57) or even greater than five pairs of flat sides (57) depending upon the angular displacement between fixed angular positions (12).

Again referring to FIGS. 9 and 10A through 10C, a particular embodiment of the rotary position selector (48) can further include a hub locking channel (58) having a channel face (59) having a generally planar surface joining in generally perpendicular relation, a pair of channel sides (60) disposed in generally opposed parallel relation. The pair of channel sides (60) can be configured to correspondingly adjacently engage one of the plurality of pairs of flat sides (57) to limit or prohibit rotation of the polygonal hub (55) about the coincident rotation axis (61) of the polygonal hub (55) and the spike (10).

Figure 10C:
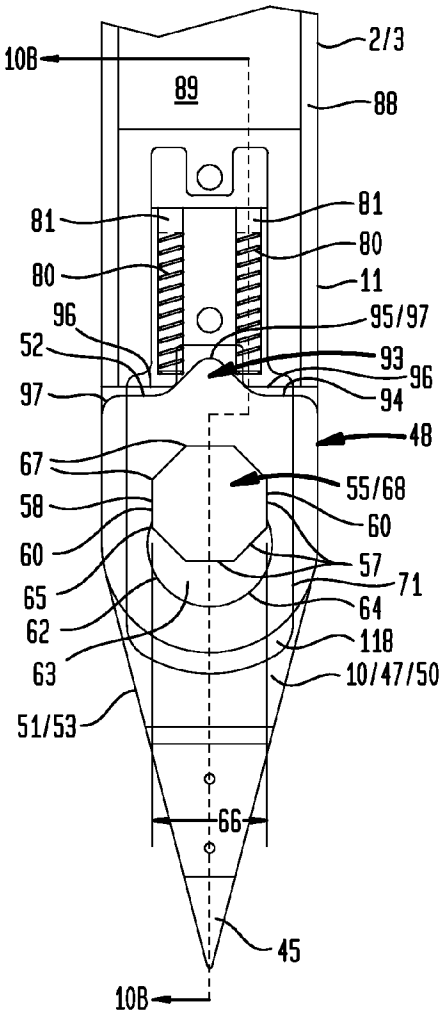
FIG. 10C is a longitudinal side cross section view 10C-10C of the spike end as shown in FIG. 10B.
Figure 10B:
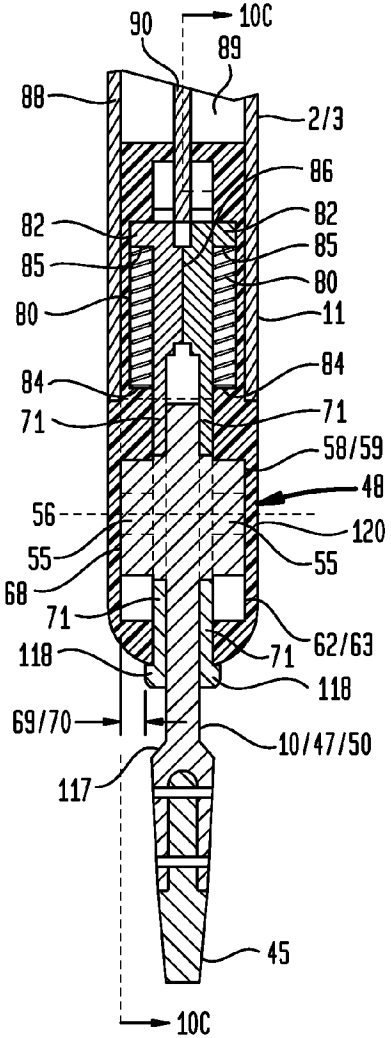
FIG. 10B is a longitudinal front cross section view 10B-10B of the spike end as shown in FIG. 10C.
Figure 10A:
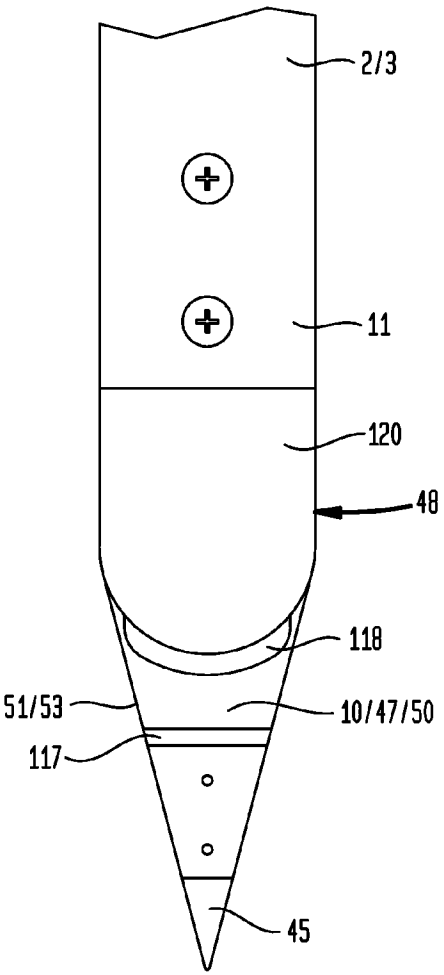
FIG. 10A is side elevation view of the spike end of a particular embodiment of the inventive ice axe.
Figure 11C:
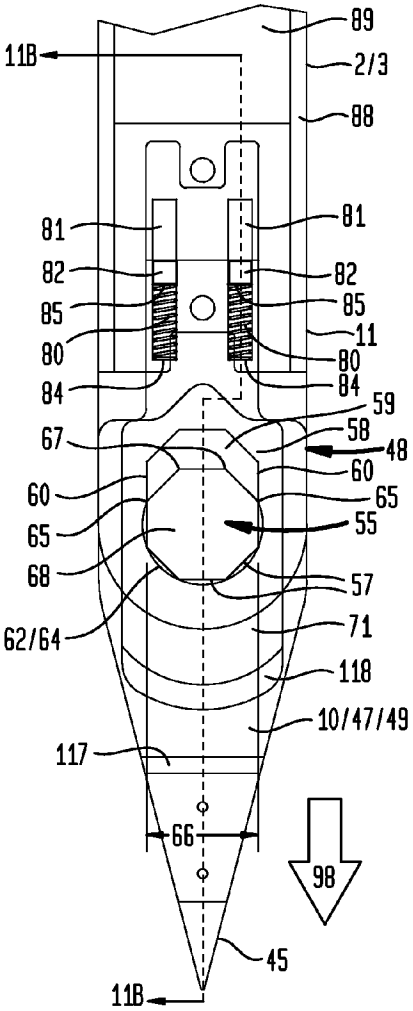
FIG. 11C is a longitudinal side cross section view 11C-11C of the spike end as shown in FIG. 11B.

Now referring primarily to FIGS. 9, and 10A through 10C and 11A through 11C and 12A through 12C, the rotary position selector (48) can further include a hub rotation socket (62) coupled to the hub locking channel (58)(as shown in the examples of FIGS. 9 and 10C). The hub rotation socket (62) can include a socket face (63) having a generally planar surface joining a socket side wall (64). The hub rotation socket (62) can be configured to receive the polygonal hub (55) from the hub locking channel (58) to disengage one of the plurality of pairs of flat sides (57) from adjacent engagement with the corresponding pair of channel sides (60) (as shown in the example of FIG. 11C). The hub rotation socket (62) can be configured to allow rotation of the polygonal hub (55) about the coincident rotation axis (61) of the polygonal hub (55) coupled to the spike (10) within the hub rotation socket (62)(as shown in the example of FIG. 11C). As to particular embodiments, the socket side wall (64) can have a generally circular configuration having a pair of arc endpoints (65) which correspondingly join the pair of channel sides (60) of the hub locking channel (58) (as shown in the example of FIGS. 9, 10C and 11C). The circular configuration of the socket side wall (64) can have a socket diameter (66) which allows sweeping engagement of a plurality hub vertices (67) of the polygonal hub (55) between the pair of arc endpoints (65)(as shown in the example of FIG. 11C).

Figure 11B:
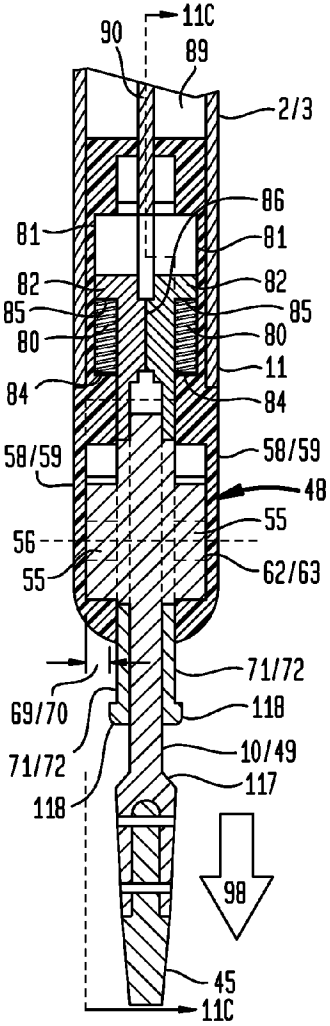
FIG. 11B is a longitudinal front cross section view 11B-11B of the spike end as shown in FIG. 11C.
Figure 12C:
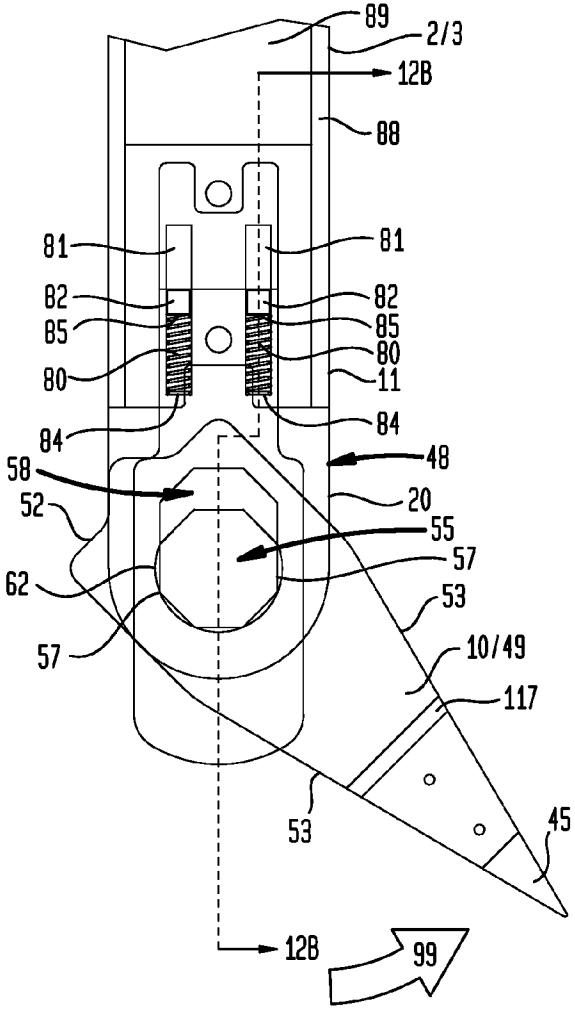
FIG. 12C is a longitudinal side cross section view 12C-12C of the spike end as shown in FIG. 12B.
Figure 12B:
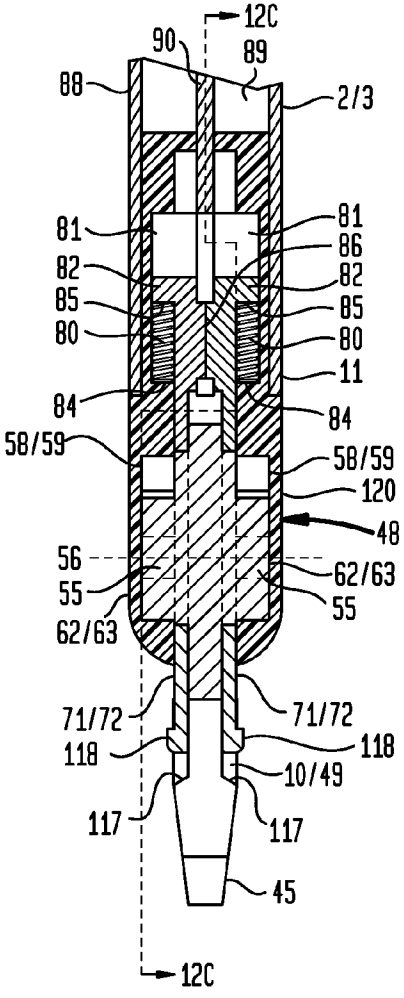
FIG. 12B is a longitudinal front cross section view 12B-12B of the spike end as shown in FIG. 12C.

Now referring primarily to FIGS. 9, 10B and 11B, and 10C and 11C, as to particular embodiments, the channel face (59) and the socket face (63) can afford a contiguous planar surface and the hub face (68) can have a generally planar configuration (as shown in the examples of FIGS. 9, 10B, 11B and 12B). The plurality of pairs of flat sides (57) can have a flat side height (69) and the socket side wall (64) can have a socket sidewall height (70) which allows adjacent sliding engagement of the hub face (68) with the contiguous planar surface of the channel face (59) and the socket face (63)(as shown in the examples of FIGS. 10B, 11B, and 12B). The polygonal hub (55) can reciprocally travel between the hub rotation socket (62) and the hub locking channel (58)(as shown by FIGS. 10C and 11C).

Now referring primarily to FIGS. 9, 10B, and 11B, as to particular embodiments, a particular embodiment of the rotary position selector (48) can further include a hub carriage (71) including a carriage body (72) which slidingly engages a carriage channel (73) to generate reciprocal travel of the polygonal hub (55) between the hub rotation socket (62) and the hub locking channel (58).

Now referring primarily to FIG. 9, as to particular embodiments, the carriage channel (73) can have a carriage channel face (74) having a generally planar surface joining, in generally perpendicular relation, a pair of carriage channel sides (75) disposed in generally linear opposed parallel relation. As to particular embodiments, the hub locking channel (58) and hub rotation socket (62) can be medially disposed in the carriage channel face (74).

The hub carriage (71) can have a carriage body (72) of planate configuration having a pair of carriage body faces (78) joined by a pair of carriage body edges (76) disposed in generally linear opposed relation and having an aperture element (77) disposed medially, and communicating between, the pair of carriage body faces (78). The aperture element (77) bounds an aperture opening (79) through which the polygonal hub (55) passes upon locating a first one of the pair of carriage body faces (78) adjacent a corresponding one of the pair of spike faces (50). The pair of carriage body edges (76) can be disposed a distance apart to correspondingly slidingly engage the pair of carriage channel sides (75) upon locating a second one of the pair of carriage body faces (78) adjacent the carriage channel face (74) and the portion of the polygonal hub (55) extending through the aperture opening (79) into the hub rotation socket (62).

Now referring primarily to FIGS. 9 and 10C, particular embodiments of the rotary position selector (48) can further include a springing element (80) responsive to movement of the hub carriage (71) to bias reciprocal travel of the polygonal hub (55) from the hub rotation socket (62) toward the hub locking channel (58). While the springing element (80) shown in the Figures has the form of a helical spring which stores sufficient mechanical energy upon compression to generate travel of the polygonal hub (55) from the hub rotation socket (62) toward the hub locking channel (58), it is not intended to preclude the use of other types of springing elements (80) such as resiliently flexible members, elastic bands, resiliently compressible cell foam, and the like, or combinations thereof.

Again referring primarily to FIGS. 9 and 10C, particular embodiments of the rotary position selector (48) can further include a springing element recess (81) medially disposed in the carriage channel face (74) between the pair of carriage channel sides (75). The springing element recess (81) can have a recess depth which receives the springing element (80) to allow the second one of the carriage body faces (78) to slidingly engage the carriage channel face (74) and travel over the springing element recess (81) containing the springing element (80). As to particular embodiments, the spring element recess (81) can be a pair of springing element recesses (81) medially disposed in the carriage channel face (74) with one of a pair of springing elements (80) correspondingly received in each of the pair of springing element recesses (81).

Now referring primarily to FIGS. 9 and 10B, 11B, and 12B, one or more projection elements (82) can outwardly extend from the second one of the hub carriage faces (78) to engage each of the springing elements (80) received within the one or more springing element recesses (81). As to particular embodiments, the springing element (80) contained in the springing element recess (81) has a springing element first end (83) engaged with a recess first end wall (84) and the projection element (82) engages the springing element second end (85). Travel of the hub carriage (71) within the carriage channel (73) to dispose the polygonal hub (55) in the hub rotation socket (62) forcibly urges the one or more projection elements (82) against the corresponding one or more springing element second ends (85) to compress the springing element (80) contained in the springing element recess (81). The stored mechanical energy in the springing element (80) acts on the one more projection elements (82) extending into the springing element recess (81) to generate travel in the hub carriage (71) which moves the polygonal hub (55) from the hub rotation socket (62) toward the hub locking channel (58) (as shown in the examples of FIGS. 10C and 11C).

Now referring primarily to FIGS. 9 and 10A, the rotary position selector (48) can have a rotary position selector external surface (120) which can be can be damaged by impact during use. As to particular embodiments, a rotary position selector external surface protector (118) extend outwardly from one of the pair of carriage body faces (78) of the carriage body (72) such that upon receipt of the polygonal hub in the a hub locking channel (58) a rotary position selector external surface protector (118) lies adjacent a portion of the rotary position selector external surface (120).

Now referring primarily to FIGS. 9, 10B, and 11B, particular embodiments of the rotary position selector (48) can further include a track follower (86) coupled to the first one of the carriage body faces (78). The track follower (86) can be configured to slidingly engage a track (87) disposed inside of the shaft (2). As to particular embodiments, the shaft (2) can include a tubular wall (88) which defines an interior tubular space (89) longitudinally bisected by a slotted member (90) to dispose a pair of slot edges (91) generally in opposed parallel relation to provide the track (87). The track follower (86) can be configured to provide a pair track follower sides (92) generally disposed in opposed parallel relation a distance apart to slidingly engage the pair of opposed slot edges (91).

Figure 12A:
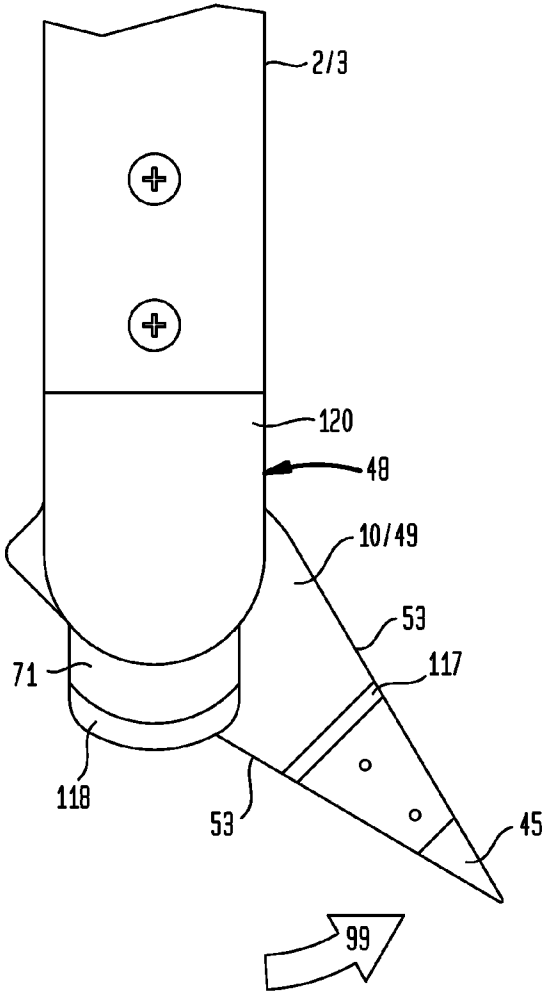
FIG. 12A is side elevation view of the spike end of a particular embodiment of the inventive ice axe.

Now referring primarily to FIGS. 9, 10C and 11C, as to particular embodiments, the spike (10) can be configured to include a rotary stop (93) which engages a structural element of the shaft (2). As an illustrative example, the base edge (52) of the spike (10) can be configured to include a rotary stop (93) including a stop linear element (94) extending between the opposed pair of side edges (53) medially interrupted by an outwardly extending stop projection element (95). Now referring primarily to FIG. 10C, the spike (10) can be established in the linear position (47) with the stop projection element (95) generally disposed between the pair of slot edges (91) to engage the stop projection element (95) with the corresponding portions of the pair of slot edges (91) and the stop linear element (94) with a pair of slotted member ends (96). Additionally, with the spike (10) disposed in the fixed angular position (12)(as shown in the example of FIG. 12A), the stop linear element (94) can provide surfaces upon which forcible urging can be applied to the spike (10) to correspondingly act on the hub carriage (71) to compress the springing element (80) allowing the polygonal hub (55) to travel from the hub locking channel (58) to the hub rotation socket (62)(as shown in the example of 11C).

Figure 13C:
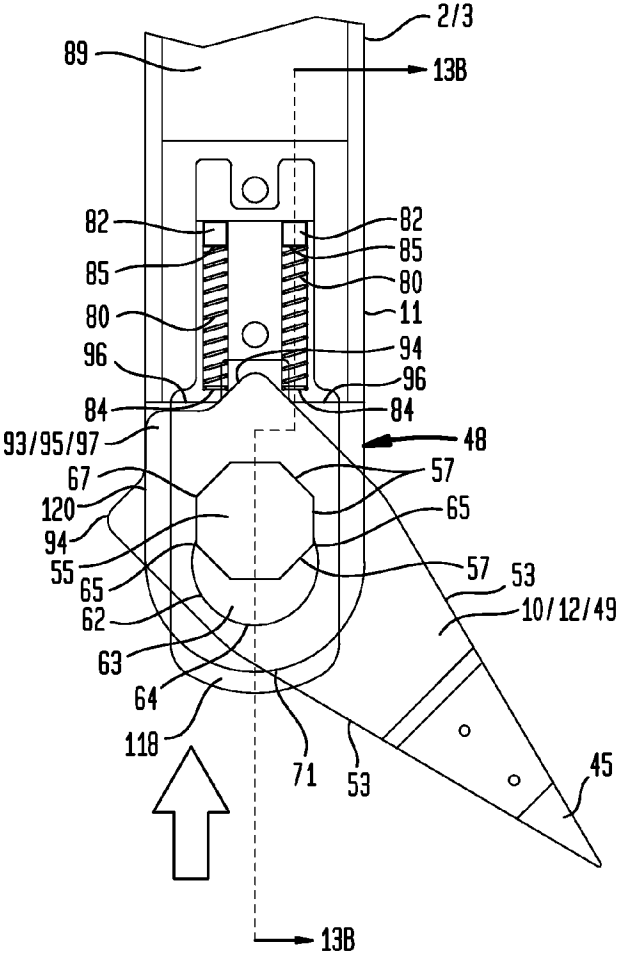
FIG. 13C is a longitudinal side cross section view 13C-13C of the spike end as shown in FIG. 13B.

Now referring primarily to FIG. 13C, the spike (10) can be established in the fixed angular position (12) with the stop projection element (95) engaged with the corresponding portions of the slotted member ends (96) and with the vertex (97) at which the stop linear element (94) and one of the pair of opposed side edges (53) meets generally disposed between the pair of slot edges (91) to engage the slop linear element (94) and the one of the pair of opposed side edges (53) with the corresponding portions of the pair of slot edges (91).

Now referring primarily to FIGS. 10A through 10C, the springing element (80) can act upon the hub carriage (71) to dispose the polygonal hub (55) in the hub locking channel (58) with a first pair of said plurality of pairs of flat sides (57) engaged with the pair of channel sides (60) to dispose the spike (10) in the linear position (47). The configuration of the rotary stop (93) can engage the corresponding portions of the shaft (2) to assist in rigidly fixing the spike (10) in the linear position (47).

Figure 11A:
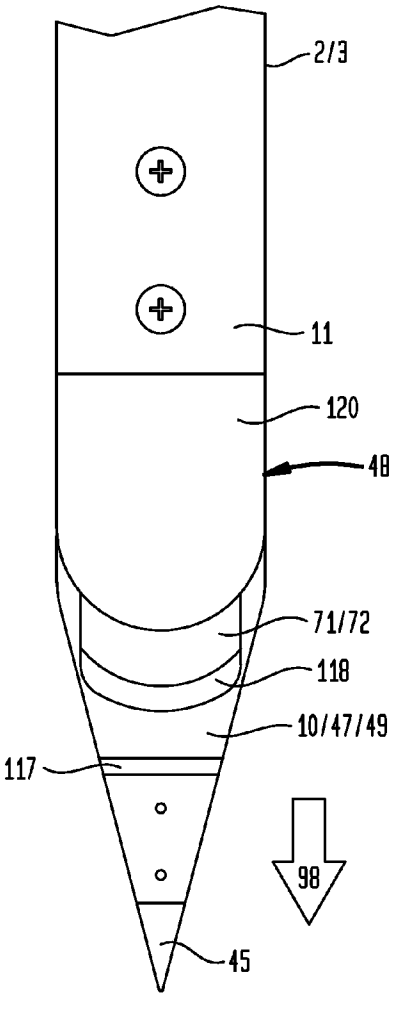
FIG. 11A is side elevation view of the spike end of a particular embodiment of the inventive ice axe.

Now referring primarily to FIGS. 11A through 11C, by outward forcible urging (98) on the spike (10), the polygonal hub (55) can act on the hub carriage (71) to compress the springing element (80) allowing the polygonal hub (55) to travel from the hub locking channel (58) to the hub rotation socket (62). As to particular embodiments, the spike (10) can further include grip element (117) which extends from the surface of the planate body (49) configured to allow gripping engagement or forcible urging engagement by the user (5) to compress the springing element (80) allowing the polygonal hub (55) to travel from the hub locking channel (58) to the hub rotation socket (62).

Now referring primarily to FIGS. 12A through 12C, by lateral forcible urging (99) on the spike (10) the polygonal hub (55) can be rotated in the hub rotation socket (62) to afford an angular displacement of the spike (10) which correspondingly aligns a second pair of the plurality of pairs of flat sides (57) with the pair of channel sides (60).

Figure 13B:
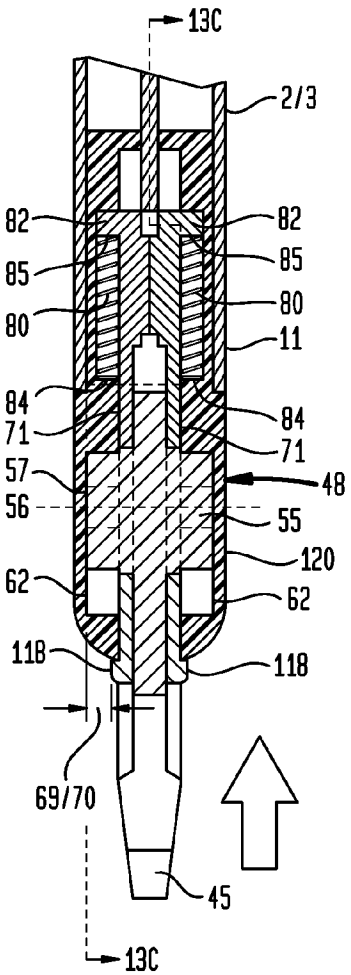
FIG. 13B is a longitudinal front cross section view 13B-13B of the spike end as shown in FIG. 13C.
Figure 13A:
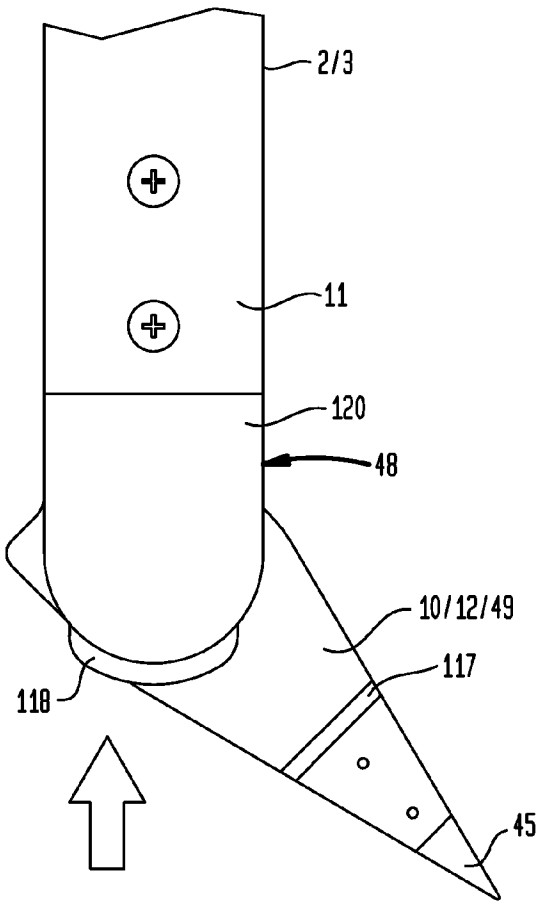
FIG. 13A is side elevation view of the spike end of a particular embodiment of the inventive ice axe.

Now referring primarily to FIGS. 13A through 13C, the mechanical forces stored in the springing element (80), can upon release of the spike (10), act on the hub carriage (71) to generate travel of the polygonal hub (55) from the hub rotation socket (62) to correspondingly engage the second pair of the plurality of pairs of flat sides (57) with the pair of channel sides (60) to dispose the spike (10) in a fixed angular position (12). The configuration of the rotary stop (93) can engage the corresponding portions of the shaft (2) to assist in rigidly fixing the spike (10) in the fixed angular position (12).

Figure 14:
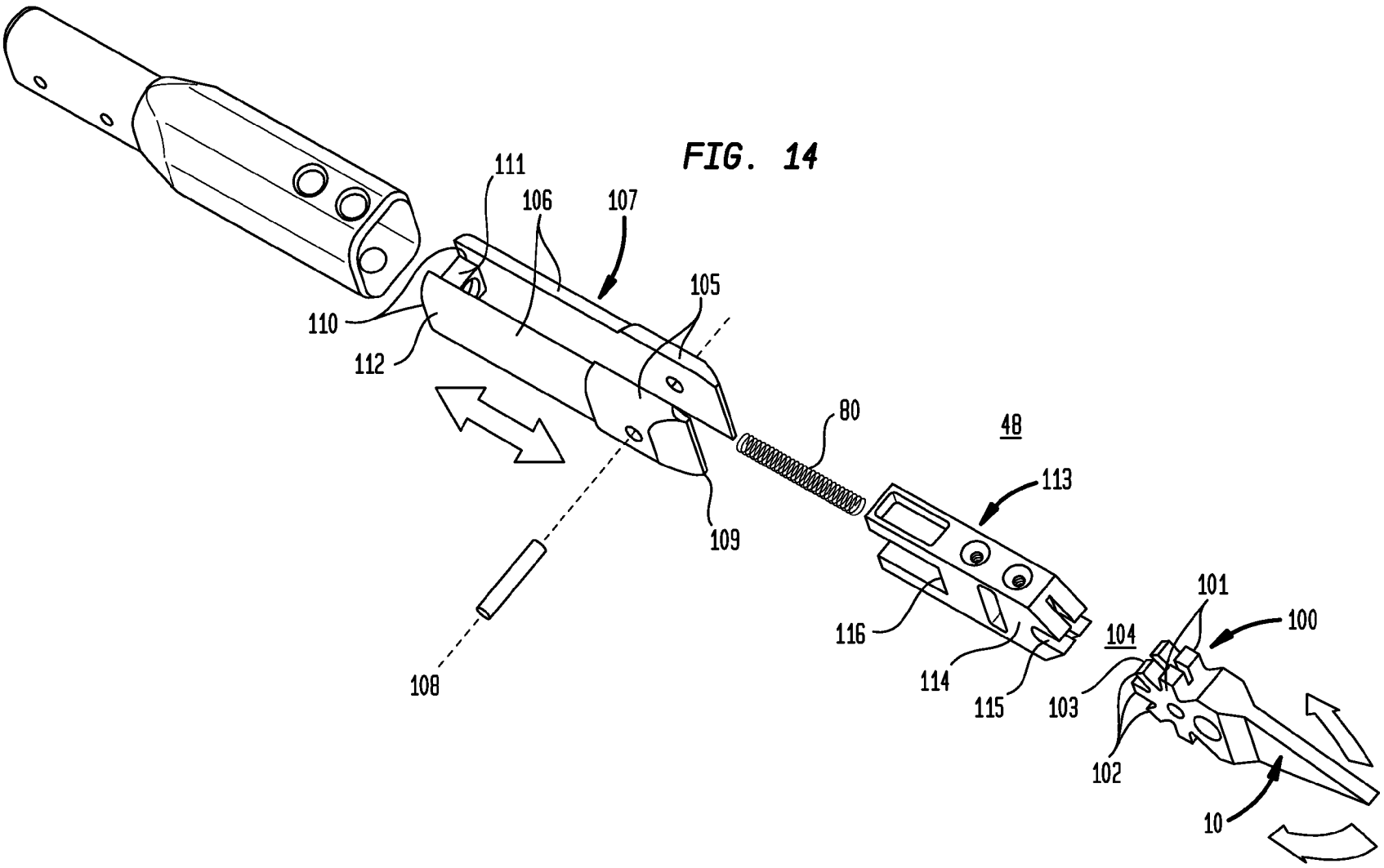
FIG. 14 is an exploded view of the spike end of a particular embodiment of the inventive ice axe.

Now referring primarily to FIG. 14, which shows an alternate embodiment of the rotary position selector (48) comprising a toothed hub (100) including a pair of hub faces (101) having substantially planar surfaces disposed in generally opposed parallel relation bound by a hub sidewall (103) of generally circular configuration. A plurality of teeth (102) can be circumferentially coupled to a sector of the hub sidewall (103) in spaced apart radially extending relation with a spike (10) coupled opposite the toothed sector (104) of the hub sidewall (103). The toothed hub (100) can be pivotally mounted to dispose the pair of hub faces (101) in corresponding adjacent relation between a pair of fork faces (105) of a pair of forks (106) of a bifurcated hub carrier (107). The toothed hub (100) can rotate about a pivot axis (108) disposed proximate a first end (109) of the bifurcated hub carrier (107)

to dispose the plurality of teeth (102) between the pair of fork faces (105). The pair of forks (106) can be joined to the opposed ends (110) of a crosspiece (111) located proximate the second end (112) of the bifurcated hub carrier (107). A catch plate (113) can be fixedly coupled between the pair of fork faces (105). The catch plate first end (114) can include a notch (115) configured to receive one of the plurality of teeth (102) which limits or prohibits rotation of the toothed hub (100) about the pivot axis (108) to establish the spike (10) in a linear position (47) or a fixed angular position (12). The bifurcate hub carrier (107) can travel within the shaft second end (11) to correspondingly generate travel in the toothed hub (100) to engage and disengage one of the plurality of teeth (102) with the notch (115) in the catch plate first end (114). A springing element (80) can be located between the crosspiece (111) of the bifurcate hub carrier (107) and a catch plate second end (116) to forcibly urge the bifurcate hub carrier (107) to travel in the shaft second end (11) to the toothed sector (104) toward the catch plate first end (114) and to maintain engagement of one of the plurality of teeth (102) with the notch (115) in the catch plate first end (114).

As can be easily understood from the foregoing, the basic concepts of the present invention may be embodied in a variety of ways. The invention involves numerous and varied embodiments of an ice axe and method of using an ice axe including the best mode.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "rotary position selector" should be understood to encompass disclosure of the act of "selecting rotary position"—whether explicitly discussed or not—and, conversely, were there effectively disclosure of the act of "selecting rotary position", such a disclosure should be understood to encompass disclosure of a "rotary position selector" and even a "means for selecting rotary position." Such alternative terms for each element or step are to be understood to be explicitly included in the description.

In addition, as to each term used it should be understood that unless its utilization in this application is inconsistent with such interpretation, common dictionary definitions should be understood to be included in the description for each term as contained in the Random House Webster's Unabridged Dictionary, second edition, each definition hereby incorporated by reference.

All numeric values herein are assumed to be modified by the term "about", whether or not explicitly indicated. For the purposes of the present invention, ranges may be expressed as from "about" one particular value to "about" another particular value. When such a range is expressed, another embodiment includes from the one particular value to the other particular value. The recitation of numerical ranges by endpoints includes all the numeric values subsumed within that range. A numerical range of one to five includes for example the numeric values 1, 1.5, 2, 2.75, 3, 3.80, 4, 5, and so forth. It will be further understood that the endpoints of each of the ranges are significant both in relation to the other endpoint, and independently of the other endpoint. When a value is expressed as an approximation by use of the antecedent "about," it will be understood that the particular value forms another embodiment. The term "about" generally refers to a range of numeric values that one of skill in the art would consider equivalent to the recited numeric value or having the same function or result. Similarly, the antecedent "substantially" means largely, but not wholly, the same form, manner or degree and the particular element will have a range of configurations as a person of ordinary skill in the art would consider as having the same function or result. When a particular element is expressed as an approximation by use of the antecedent "substantially," it will be understood that the particular element forms another embodiment.

Moreover, for the purposes of the present invention, the term "a" or "an" entity refers to one or more of that entity unless otherwise limited. As such, the terms "a" or "an", "one or more" and "at least one" can be used interchangeably herein.

Thus, the applicant(s) should be understood to claim at least: i) each of the ice axes herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

Additionally, the claims set forth in this specification, if any, are further intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claimed:

1. An ice axe comprising:

a shaft having a length disposed between a shaft first end and a shaft second end;

a spike rotatably coupled to said shaft second end; and a rotary position selector coupled to said spike which allows selectable fixed angular positioning of said spike about a spike rotation axis;

wherein said rotary position selector comprises:

an angular positioning lock, including:

a polygonal hub coupled to said spike, said polygonal hub and said spike having a coincident rotation axis, said polygonal hub having a plurality of pairs of flat sides each of said plurality of pairs of flat sides disposed in generally opposed parallel relation a distance apart, each of said plurality of pairs of flat sides having an angular displacement about said coincident rotation axis corresponding to a selectable fixed angular position of said spike; and a hub locking channel having a pair of channel sides disposed in generally opposed parallel relation configured to correspondingly adjacently engage one of said plurality of pairs of fiat sides to limit rotation of said polygonal hub about said coincident rotation axis.

2. The ice axe of claim 1, wherein said rotary position selector further comprises a hub rotation socket coupled to said hub locking channel, said hub rotation socket configured to receive said polygonal hub from said hub locking channel to allow rotation of said polygonal hub about said coincident rotation axis.

3. The ice axe of claim 2, wherein said rotary position selector further comprises a hub carriage which operates to move said polygonal hub between said hub rotation socket and said hub locking channel.

4. The ice axe of claim 3, wherein said hub carriage, includes:

a carriage body having an aperture element communicating between opposed carriage faces, said aperture element bounds an aperture element opening through which said polygonal hub passes upon locating one of said opposed carriage faces adjacent said spike; and a carriage channel configured to receive said carriage body having said polygonal hub passing through said aperture element opening to dispose said polygonal hub in said hub rotation socket, said carriage body slidingly engages said carriage channel to move said polygonal hub between said hub rotation socket and said hub locking channel.

5. The ice axe of claim 4, wherein said spike has opposed spike faces having planar surfaces, and wherein said opposed carriage faces have planar surfaces joined by a pair of linear edges disposed in generally opposed parallel relation, and wherein said carriage channel has a pair of linear carriage channel sides disposed in generally opposed parallel relation configured to correspondingly adjacently engage said pair of linear edges of said carriage body.

6. The ice axe of claim 5, wherein said rotary position selector further comprises a springing element responsive to movement of said hub carriage, said springing element configured to bias movement of said polygonal hub from said hub rotation socket toward said hub locking channel.

7. The ice axe of claim 6, wherein said rotary position selector further comprises a springing element recess disposed in a carriage channel face joining said pair of linear carriage channel sides, wherein said carriage body slidingly overlays said springing element received within said springing element recess to allow movement of said polygonal hub from said hub rotation socket toward said hub locking channel.

8. The ice axe of claim 7, wherein said rotary position selector further comprises a projection element which outwardly extends from said carriage body to engage said springing element received within said springing element recess.

9. The ice axe of claim 8, wherein said rotary position selector further comprises a track follower coupled to said carriage body opposite said projection element, said track follower configured to slidingly engage a track disposed within said shaft.

10. The ice axe of claim 9, wherein said shaft defines an interior tubular space, and wherein said track comprises opposed slot edges of a slotted member which longitudinally bisects said interior tubular space, said track follower configured to slidingly engage said opposed slot edges.

11. The ice axe of claim 10, wherein said slotted member terminates in opposed slotted member ends, said spike further includes a rotary stop configured to engage at least one of said opposed slot edges or one of said opposed slotted member ends upon location of said polygonal hub in said hub locking channel.

12. The ice axe of claim 11, wherein said polygonal hub comprises a pair of polygonal hubs coupled to said opposed spike faces, said pair of polygonal hubs and said spike having said coincident rotation axis, and wherein said carriage body comprises a pair of carriage bodies each having an aperture element communicating between said opposed carriage faces, each said aperture element bounds an aperture element opening through which one of said pair of polygonal hubs passes upon correspondingly locating one of said pair of carriage bodies adjacent one of said opposed spike faces, and wherein said carriage channel comprises a pair of carriage channels each of which correspondingly receives one of said pair of carriage bodies to dispose one of said pair of polygonal hubs in a corresponding one of a pair of hub rotation sockets, each of said pair of carriage bodies correspondingly slidingly engage one of said pair of carriage channels to concurrently move said pair of polygonal hubs between said corresponding pair of hub rotation sockets and a pair of hub locking channels.

13. The ice axe of claim 12, further comprising a head coupled to said shaft first end, wherein said head includes an adze and a pick extending outwardly in opposed relation from said shaft.

14. The ice axe of claim 13, wherein said pick comprises:

a planate blade having a pair of planar blade faces disposed in opposed relation a blade thickness apart, said planar blade faces bound by a blade top edge and a blade bottom edge which extend outwardly from a head body to terminate in a blade tip; and a planate fin having a fin length disposed between a fin first end and a fin second end and having a fin medial portion disposed between a pair of fin sides, said fin orthogonally coupled to said blade top edge along the fin medial portion with said fin first end disposed proximate said shaft first end, said fin first side and said fin second side disposed on opposite sides of said blade top edge.

15. The ice axe of claim 14, wherein said blade bottom edge further includes a serrated edge portion.

16. The ice axe of claim 15, wherein said adze comprises:

a planate adze member having a top side and a bottom side which taper to an adze cutting element;

an elongate rib extending medially along the length of said bottom side.

17. The ice axe of claim 16, where said elongate rib proximate said adze cutting element angles inwardly to join said bottom side to provide an adze cutting element.

* * * * *